US010967283B2

(12) United States Patent
Hunter et al.

(10) Patent No.: US 10,967,283 B2
(45) Date of Patent: Apr. 6, 2021

(54) WATERSLIDE FEATURE, RIDE VEHICLE AND METHOD

(71) Applicant: PROSLIDE TECHNOLOGY INC., Ottawa (CA)

(72) Inventors: Richard Douglas Hunter, Ottawa (CA); Raymond Thomas Smegal, Ottawa (CA)

(73) Assignee: ProSlide Technology Inc., Ottawa (CA)

( * ) Notice: Subject to any disclaimer, the term of this patent is extended or adjusted under 35 U.S.C. 154(b) by 0 days.

(21) Appl. No.: 16/317,946

(22) PCT Filed: Jul. 15, 2016

(86) PCT No.: PCT/CA2016/050838
§ 371 (c)(1),
(2) Date: Jan. 15, 2019

(87) PCT Pub. No.: WO2018/010003
PCT Pub. Date: Jan. 18, 2018

(65) Prior Publication Data
US 2019/0232178 A1 Aug. 1, 2019

(51) Int. Cl.
*A63G 21/18* (2006.01)
*A63G 31/00* (2006.01)

(52) U.S. Cl.
CPC ..... *A63G 21/18* (2013.01)

(58) Field of Classification Search
CPC ..... A63G 21/00; A63G 21/18; A63G 31/00; A63G 31/007
USPC ..... 472/13, 117, 128, 129; 104/69–70
See application file for complete search history.

(56) References Cited

U.S. PATENT DOCUMENTS

| | | | |
|---|---|---|---|
| 2,604,055 | A | 7/1949 | Snowden |
| 3,000,022 | A | 9/1961 | Cathey et al. |
| 3,438,074 | A | 4/1969 | Goyen |
| 5,031,556 | A | 6/1991 | Blee |
| 5,213,547 | A | 5/1993 | Lochtefeld et al. |
| 5,219,315 | A | 6/1993 | Fuller et al. |

(Continued)

FOREIGN PATENT DOCUMENTS

| | | | |
|---|---|---|---|
| CA | 2654714 | A1 | 3/2002 |
| CA | 2674329 | A1 | 1/2011 |

(Continued)

OTHER PUBLICATIONS

International Search Report, issued by the Canadian Intellectual Property Office, International Application No. PCT/CA2016/050838, dated Mar. 17, 2017, 12 pages.

(Continued)

*Primary Examiner* — Kien T Nguyen
(74) *Attorney, Agent, or Firm* — Finnegan, Henderson, Farabow, Garrett & Dunner, L.L.P.

(57) ABSTRACT

A waterslide feature comprises a channel having a sliding surface and walls. The walls define a plurality of recesses. A nozzle extends through each of the recesses angled to spray water over the sliding surface. The nozzles are positioned to provide a flow of water to impact a vehicle sliding on the sliding surface. The nozzles are sized to provide a flow of water sufficient to affect motion of the vehicle. The vehicle may include an attachment to enhance the effectiveness of the flow of water.

20 Claims, 13 Drawing Sheets

(56) References Cited

U.S. PATENT DOCUMENTS

| | | | | |
|---|---|---|---|---|
| 5,230,662 | A | 7/1993 | Langford | |
| 5,401,214 | A | 3/1995 | Smollar et al. | |
| 5,503,597 | A | 4/1996 | Lochtefeld et al. | |
| 5,527,646 | A | 6/1996 | Ogino et al. | |
| 5,716,282 | A | 2/1998 | Ring | |
| 5,738,590 | A | 4/1998 | Lochtefeld | |
| 6,006,672 | A | 12/1999 | Newfarmer et al. | |
| 6,435,927 | B1 | 8/2002 | Fireman | |
| 6,527,646 | B1 | 3/2003 | Briggs | |
| 6,561,914 | B2 | 5/2003 | Henry | |
| 6,702,687 | B1 | 3/2004 | Henry | |
| 6,743,108 | B2 | 6/2004 | Hunter | |
| 6,758,231 | B1 * | 7/2004 | Lochtefeld | A63G 3/00 104/70 |
| 7,229,359 | B2 | 6/2007 | Henry | |
| 7,285,053 | B2 | 10/2007 | Henry et al. | |
| 7,497,784 | B2 | 3/2009 | Henry | |
| 7,727,077 | B2 | 6/2010 | Henry et al. | |
| 7,731,595 | B2 | 6/2010 | Hlynka | |
| 7,740,542 | B2 | 6/2010 | Henry et al. | |
| 7,758,435 | B2 | 7/2010 | Henry et al. | |
| 7,758,535 | B2 | 7/2010 | Levine et al. | |
| 7,762,900 | B2 * | 7/2010 | Henry | A63G 21/18 472/117 |
| 7,766,753 | B2 | 8/2010 | Henry et al. | |
| 7,785,207 | B2 | 8/2010 | Henry et al. | |
| 7,896,752 | B2 | 3/2011 | Yule | |
| 7,942,752 | B2 | 5/2011 | Henry | |
| 8,070,616 | B2 | 12/2011 | Dubois et al. | |
| 8,075,413 | B2 | 12/2011 | Henry et al. | |
| 8,079,916 | B2 | 12/2011 | Henry | |
| 8,197,353 | B2 | 6/2012 | Brassard | |
| 8,210,954 | B2 | 7/2012 | Henry et al. | |
| 8,282,497 | B2 | 10/2012 | Henry et al. | |
| 8,453,579 | B2 | 6/2013 | Nemeth | |
| 8,579,715 | B2 | 11/2013 | Olive et al. | |
| 9,220,989 | B2 | 12/2015 | Fisher | |
| 2002/0082097 | A1 | 6/2002 | Henry | |
| 2003/0069078 | A1 | 4/2003 | Aragona et al. | |
| 2005/0034768 | A1 | 2/2005 | Lochtefeld et al. | |
| 2007/0060403 | A1 | 3/2007 | Henry | |
| 2010/0160054 | A1 | 6/2010 | Henry | |
| 2011/0028227 | A1 | 2/2011 | Dubois et al. | |
| 2012/0201605 | A1 | 9/2012 | Hill | |
| 2012/0258812 | A1 | 10/2012 | Osterman et al. | |
| 2013/0184087 | A1 | 7/2013 | Degirmenci | |
| 2014/0171211 | A1 | 6/2014 | Fisher | |
| 2016/0136527 | A1 | 5/2016 | Hunter | |
| 2017/0043264 | A1 | 2/2017 | Hunter et al. | |

FOREIGN PATENT DOCUMENTS

| | | | |
|---|---|---|---|
| CA | 2888630 | A1 | 4/2014 |
| CN | 2 905 159 | | 5/2007 |
| CN | 101 417 179 | A | 4/2009 |
| CN | 104797312 | A | 7/2015 |
| EP | 0601641 | A1 | 6/1994 |
| JP | H-03258280 | | 11/1991 |
| JP | 10-216363 | | 8/1998 |
| RU | 68338 | U1 | 11/2007 |
| WO | WO 88/05745 | A1 | 8/1988 |
| WO | WO 9204087 | A1 | 3/1992 |
| WO | WO2007/027841 | A2 | 3/2007 |
| WO | WO 2012/048016 | A2 | 4/2012 |
| WO | WO 2013/000090 | A1 | 1/2013 |
| WO | WO 2014/059551 | A1 | 4/2014 |
| WO | WO 2015/161382 | A1 | 10/2015 |

OTHER PUBLICATIONS

Decision on Grant, issued by the Russian Patent Office, in corresponding Russian Application No. 2016 145 423 A, (8 pages).
Third Party Observation in corresponding PCT/CA2016/050838, filed Jul. 15, 2016 (5 pages).
Second Office Action, issued in corresponding Chinese Application No. 2013/80060304.0, from the Chinese Patent Office, dated May 15, 2017 (19 pages).
Third Office Action, issued in corresponding Chinese Application No. 2013/80060304.0, from the Chinese Patent Office, dated Feb. 23, 2018 (20 pages).
Extended European Search Report, pursuant to Rule 62 EPC, from the European Patent Office, issued in Application No. 16192350.3-1658, dated Mar. 28, 2017, 8 pages.
Office Action, issued in corresponding Chinese Application No. 20130060304.0, from the Chinese Patent Office, dated Jun. 29, 2016.
International Search Report, dated Jan. 2, 2014, from the Canadian Intellectual Property Office in corresponding International Application No. PCT/CA2013/050794, 2 pages.
Office Action, issued in corresponding Chinese Application No. 201380060304.0, from the Chinese Patent Office, dated May 15, 2017.
Third Party Observation issued in corresponding International application No. PCT/CA2016/050838 dated Feb. 6, 2018.
Search Report and Written Opinion, issued by the Intellectual Property Office of Singapore, in corresponding Patent Application No. 11201608816S, dated Nov. 28, 2017, 10 pages.
Office Action, dated Jul. 28, 2017, issued in U.S. Appl. No. 15/305,859 (7 pages).
Communication pursuant to Rule 69 EPC, from the European Patent Office, issued in corresponding Application No. 16192350.3-1658, dated May 3, 2017, 2 pages.
Communication pursuant to Rule 62 EPC, from the European Patent Office, issued in corresponding Application No. 15783231.2-1658, regarding Supplementary European Search Report, dated Nov. 3, 2017, 9 pages.
Communication pursuant to Rules 70(2) and 70a(2) EPC, from the European Patent Office, issued in corresponding Application No. 15783231.2-1658. dated Nov. 21, 2017, 1 page.
First Office Action Examination Report, issued by the Chinese Patent Office, in corresponding Application No. 2016/80088550.0 (27 pages).
Supplementary European Search Report, issued by the European Patent Office, in corresponding Application No. Ep 16 90 8371, dated Jan. 13, 2020 (6 pages).
JP 75956-577, Notice of Reasons for Rejections, issued by the Japanese Patent Office, in corresponding Application No. 2019-501632 (4 pages).
RU Office Notification, issued in Application No. 2019/104086/12, dated Aug. 27, 2019 (7 pages).
RU Search Report, issued in Application No. 2019/104086/12, dated Aug. 16, 2019 (4 pages).
SG Written Opinion, issued by the Intellectual Property Office of Singapore, in corresponding Application No. 11201900151T, (8 pages).
Office Action, issued from the Korean Intellectual Property Office, in corresponding Korean Application No. 10-2015-7013127, 15 pages

* cited by examiner

WATERSLIDE FEATURE, RIDE VEHICLE AND METHOD

FIELD OF THE INVENTION

The invention relates generally to amusement rides, and in particular to rides in which participants ride in or on vehicles.

BACKGROUND OF THE INVENTION

In the past few decades, water-based amusement rides have become increasingly popular. A common type of water-based amusement ride is a flume-style waterslide in which one or more participants ride in a vehicle which slides along a channel or "flume" over a water lubricated surface from the start of the waterslide to the end of the waterslide.

Water is provided in the flume to provide lubrication between the vehicle and the flume surface, and to provide cooling and splashing effects. Typically, the motion of the participant in the flume is controlled predominantly by the contours of the flume (hills, valleys, turns, drops, etc.) in combination with gravity. However, various techniques have been applied to accelerate or decelerate participants by means other than gravity.

Once the participants and vehicle arrive at the end of the waterslide, the vehicle must be transported back to the start of the waterslide. The waterslide continues to operate while vehicles are transported back to the start of the waterslide. As such, each waterslide requires a significant number of vehicles to ensure that there is no delay in the operation of the waterslide while vehicles are being transported back to the start of the waterslide.

SUMMARY OF THE INVENTION

In some embodiments, there is provided a waterslide feature comprising: a channel comprising a sliding surface and walls; the walls defining a plurality of recesses; a plurality of nozzles comprising a nozzle extending through each of the recesses angled to spray water over the sliding surface; wherein the nozzles are positioned to provide a flow of water to impact a vehicle sliding on the sliding surface; and wherein the nozzles are sized to provide a flow of water sufficient to affect motion of the vehicle.

In some embodiments each of the recesses defines an opening though the walls and each of the nozzles are connected to a source of water through the respective openings in the walls.

In some embodiments each of the recesses define a rear wall angled towards the channel for mounting one of the nozzles and the cross section of each recess tapers from the rear wall to a surface of the channel.

In some embodiments the recesses taper inward to define top and bottom walls substantially perpendicular to the rear wall and the channel.

In some embodiments each of the nozzles define an outlet end which is within the respective recess and an inlet end which is outside the channel.

In some embodiments the nozzles are formed of polyvinyl chloride.

In some embodiments each of the nozzles comprise a collar within the respective recess and a cylinder extending outside the channel.

In some embodiments the inlet end comprises a press fit feature which is fitted into a flexible conduit connected by a clamp.

In some embodiments the plurality of nozzles are connected to a water source in groups wherein the flow of water to each group is separately controlled.

In some embodiments a water flow rate is variable between 15 GPM and 40 GPM per nozzle.

In some embodiments water pressure in the nozzle is variable between 5 psi and 30 psi.

In some embodiments the nozzle spray pattern is variable from cylindrical to conical.

In some embodiments the nozzles are positioned spray no more than 6.25 inches above the sliding surface.

In some embodiments the nozzles are positioned spray less than approximately 8.75 inches above the sliding surface.

In some embodiments there is provided troughs along the sides of the uphill and downhill sections of the sliding surface.

In some embodiments there is provided a trough below the sliding surface and grates along uphill and downhill sections of the sliding surface opening into the trough to allow water to flow from the sliding surface to the trough, wherein the grates comprise laterally extending cylindrical bars.

In some embodiments the waterslide comprises upper walls including removable windows.

In some embodiments the upper walls enclose the waterslide feature.

In some embodiments there is provided an inflatable waterslide vehicle with outwardly curving sides wherein the water jets are angled to impact the vehicle no higher than a cross-sectional equator of the sides of the vehicle.

In some embodiments the water jets are angled to impact the vehicle below the cross-sectional equator of the sides of the vehicle.

In some embodiments there is provided an inflatable waterslide vehicle wherein the vehicle comprises a body having a perimeter, the attachment comprising a support structure fixable to the perimeter of the vehicle and at least one projection extending outward from the support structure, the projection being sized to affect motion of the vehicle when fixed to the vehicle and impacted by a water.

In some embodiments the support structure is elongated and is fixable to the vehicle at longitudinal ends of the support structure.

In some embodiments the support structure is fixable to the vehicle at an intermediate location.

In some embodiments the support is fixable by use of adhesive strips.

In some embodiments the support is flexible to be fixable to a non-planer vehicle perimeter.

In some embodiments the projection comprises at least two projections.

In some embodiments the projection comprises at least one pocket defined by an opening at a first end tapering to a closed second end.

In some embodiments the projection tapers both inwardly toward the support and laterally toward the center of the support.

In some embodiments an inner wall of the pocket adjacent the support structure is longer than an outer wall of the pocket opposite the support structure wherein the opening is angled away from the support structure.

In some embodiments the support structure and the projections are formed of the same material.

In some embodiments the support structure is tubular and sized to encircle a portion of the vehicle.

In some embodiments there is provided an inflatable waterslide vehicle wherein the vehicle comprises a body having a perimeter, the method comprising fixing the projection to a support structure using an adhesive; positioning the support structure on the perimeter of the vehicle at a location where water impacting the projection will affect motion of the vehicle, and fixing longitudinal ends of the support structure to the perimeter of the vehicle using adhesive strips.

In some embodiments there is provided method of adapting an inflatable raft for use with waterslide utilizing water jets to affect the motion of the inflatable raft, wherein the inflatable comprises a body having a perimeter, the method comprising: fixing at least one projection to a support structure using an adhesive; positioning the support structure on the perimeter of the vehicle such that water impacting the projection will affect motion of the vehicle, and fixing longitudinal ends of the support structure to the perimeter of the vehicle using adhesive strips.

In some embodiments there is provided a method of affixing a projection to an inflatable waterslide vehicle wherein the vehicle comprises a body having a perimeter, the method comprising fixing the projection to a support structure using an adhesive; fixing the support structure to a tubular member, under inflating the vehicle, positioning the tubular member around the body of the vehicle such that water impacting the projection will affect motion of the vehicle, and fully inflating the vehicle to retain the tubular member in position.

BRIEF DESCRIPTION OF THE DRAWINGS

Embodiments of the invention will now be described with reference to the attached drawings in which.

DETAILED DESCRIPTION OF THE EMBODIMENTS OF THE INVENTION

Figure 1:
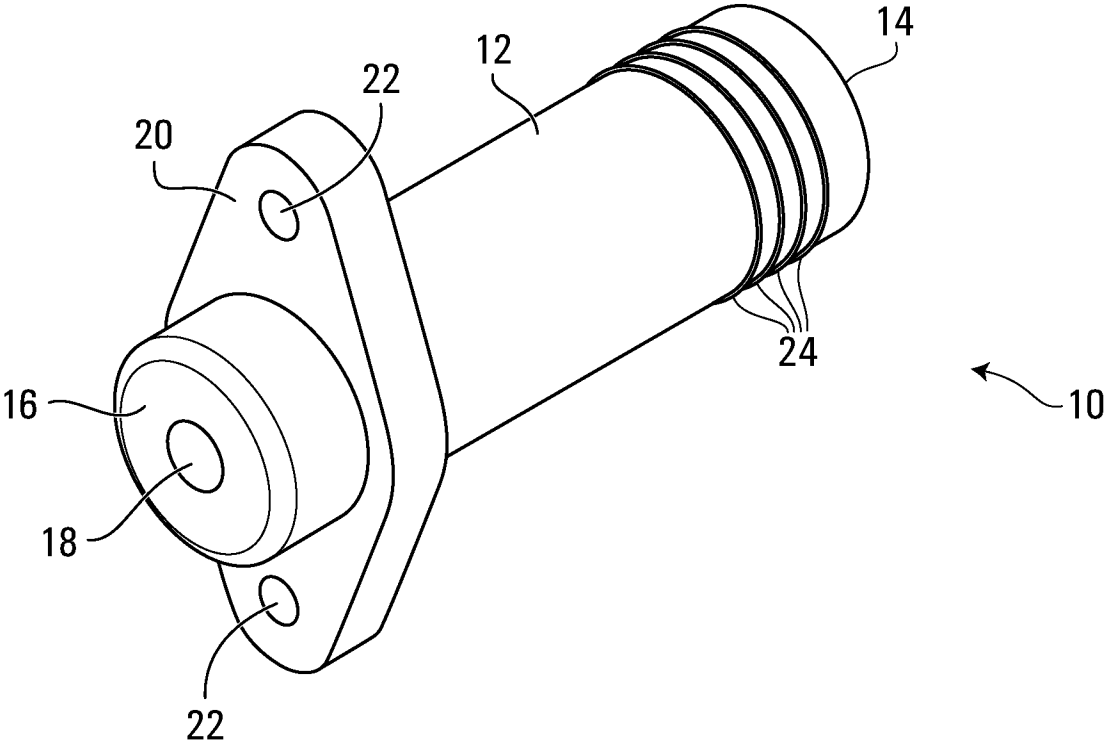
FIG. 1 is a perspective view of a nozzle of an embodiment of the invention.

FIG. 1 shows a nozzle 10 according to an embodiment of the invention. In this embodiment the nozzle 10 is formed from machined polyvinyl chloride (PVC). The nozzle 10 comprises a cylindrical body 12 with an inlet end 14 and an outlet end 16. A tubular channel 18 is defined through the cylindrical body 12 from the inlet end 14 to the outlet end 16.

Adjacent to the outlet end 16 is a collar 20. The collar 20 protrudes outward perpendicular from the cylindrical body 12 and perpendicular to the longitudinal length of the cylindrical body 12. The collar 20 has two holes 22 defined there through parallel to and on opposite sides of the tubular channel 18.

Adjacent the inlet end 14 are four spaced apart ring shaped projections 24 which encircle the cylindrical body 12. These ring shaped projections 24 can help to retain a hose on the cylindrical body 12 in use as further discussed below.

Although a particular shape and type of a nozzle 10 is described, it will be appreciated that various other nozzle shapes and types may be employed. For example, other shapes of projections and/or depressions may be provided to assist in retaining hose or other flexible conduit to the nozzle 10, and at other locations on the nozzle 10, or may be eliminated, or replaced with threading for use with an inflexible conduit. The collar 20 may be at another location, have another shape or may be eliminated. For example, the holes 22 may be omitted and an adhesive or sealant may be used to fix the nozzle 10 in place. With the use of an adhesive or sealant around the cylindrical body 12, the collar 20 could be omitted. In some embodiments, the nozzle is formed in two parts, which may facilitate their installation and removal.

In some embodiments, the nozzle 10 may incorporate one or more valves to assist in controlling the flow of water through the nozzle 10.

Figure 2:
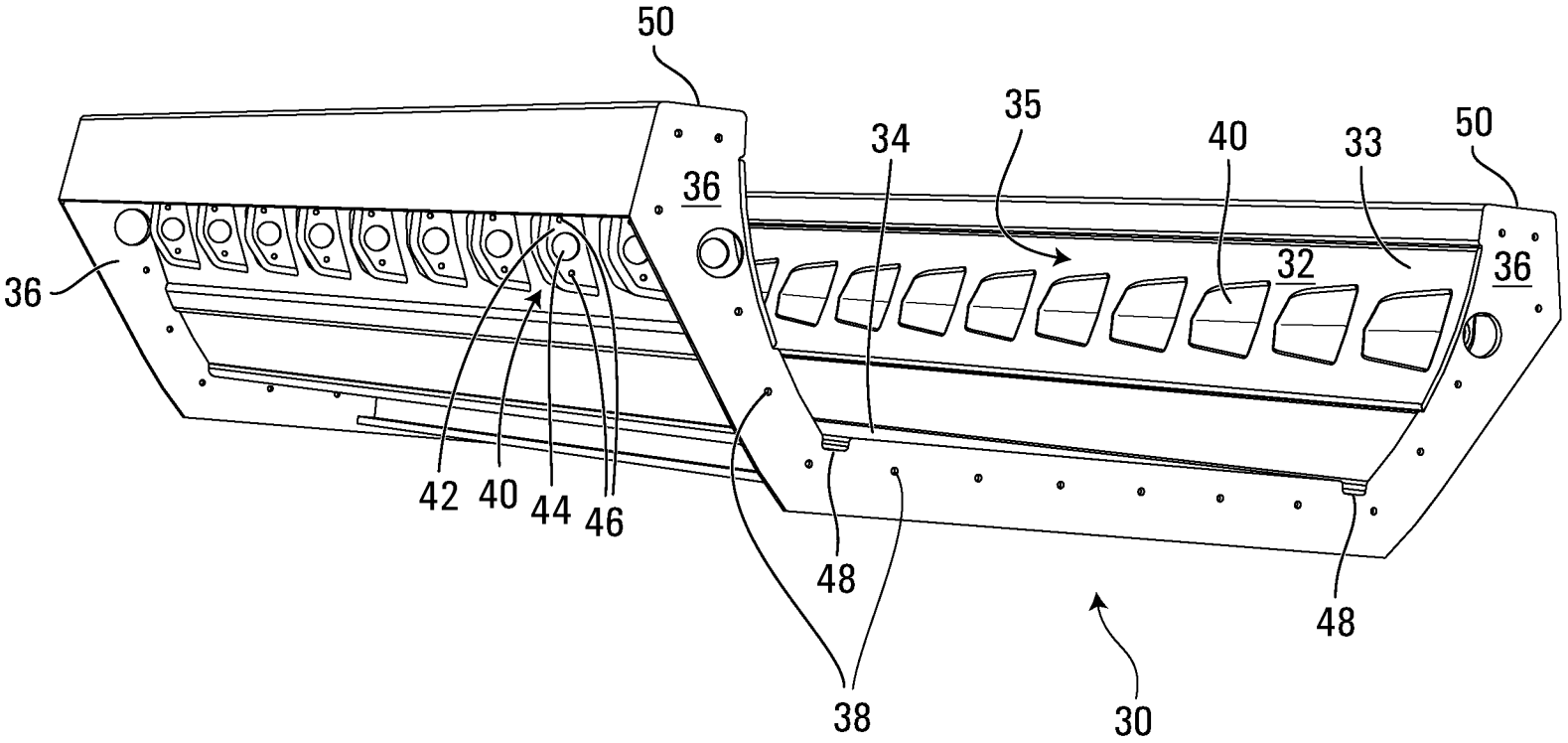
FIG. 2 is a perspective view of a component of the waterslide structure of the invention.

FIG. 2 shows a component 30 for a waterslide. The component 30 includes two walls 32 and a bottom 34 connecting the walls 32. The walls 32 extend upward and are angled and curved slightly outwardly and together with the bottom form a channel 35 there between. The ends of the walls 32 and the bottom 34 comprise flanges 36 projecting continuously outwardly around and perpendicular to the ends of the walls 32 and the bottom 34. The flanges 36 incorporate holes 38 spaced around and extending through the flanges 36. The holes 38 allow the component 30 to be connected end to end with other such components of a waterslide.

A series of recesses 40 are defined along the interior of the walls 32, projecting inwardly from the interior surface 33 of the walls 31 and projecting outward on the exterior of the walls 32. In this embodiment, there are 10 closely spaced recesses 40 extending lengthwise along each wall at the same height from the bottom 34. A rearward wall 42 of each of the recesses 40 includes a large opening or hole 44 and two small openings or holes 46 extending there through. The large holes 44 is sized to accommodate the cylindrical body 12 of the nozzles 10 and the small holes 46 are positioned and sized to mirror the holes 22 in the collar 20 of the nozzle 10. This enables a nozzle 10 to be fastened in each recesses 40 inset from the interior surface of the wall 32.

It will be appreciated that there are numerous possible shapes, numbers and positions of recesses 40 including more or fewer, located at lower, higher or variable heights, and having numerous different shapes. The recesses may also be omitted. Similarly, there are numerous ways in which nozzles 10 can be connect to spray water into the channel and the nozzles 10 may be omitted or replaced by other spraying equipment.

In this embodiment, the bottom 34 in substantially flat but has troughs 48 extending along adjacent each of the walls 32. In some embodiments, the troughs 48 allow water to drain away from the sliding surface defined by the bottom 34. In other embodiments, a separate sliding surface (see FIG. 5) may be provided with holes or other openings through the sliding surface provided to allow water to drain through the sliding surface and be drained away in a space defined between the sliding surface and the bottom.

Each of the walls 32 of this embodiment has a flat upper surface 50. This flat upper surface 50 allows for an upper wall to be attached above the walls 32 to, for example, provide for water retention within the channel 35 of the waterslide, and as a safety feature to retain riders within the waterslide.

Figure 3:
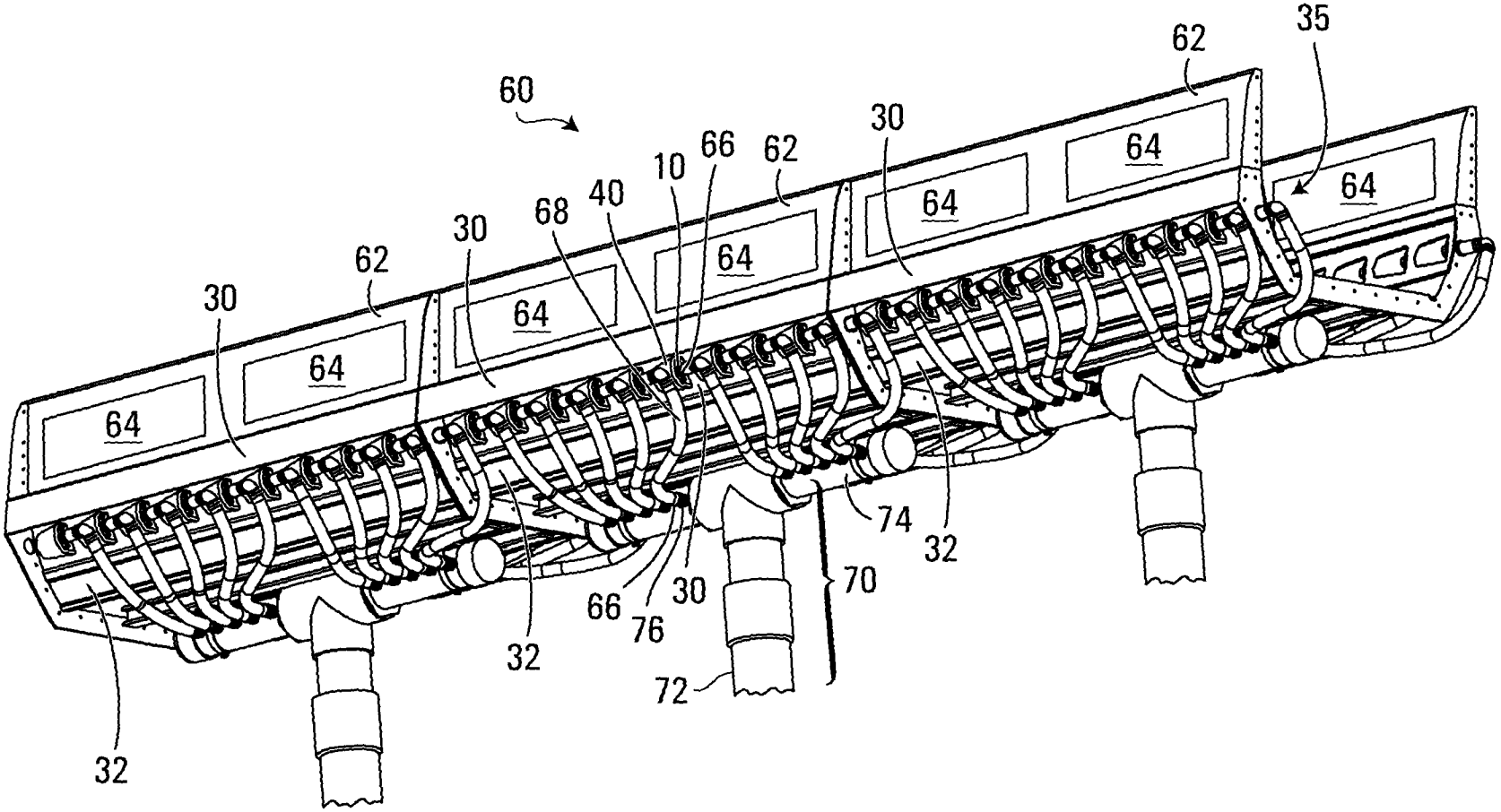
FIG. 3 is a schematic bottom perspective view of a section of a waterslide according to an embodiment of the invention including three of the components of FIG. 2.

FIG. 3 depicts the exterior of a feature or section of a waterslide 60. The waterslide feature 60 incorporates three of waterslide components 30. On top of each of the walls 32 of the components 30 are mounted upper walls 62. The upper walls 62 incorporate windows 64. The windows 64 may, for example, be removable from the upper walls 62 and attached by Velcro. In some embodiments, the upper walls 62 may be high enough to retain substantially all of the water within the waterslide feature 60 feature and may curve inward and may meet at the top such that the waterslide feature 60 is completely enclosed.

Figure 4:
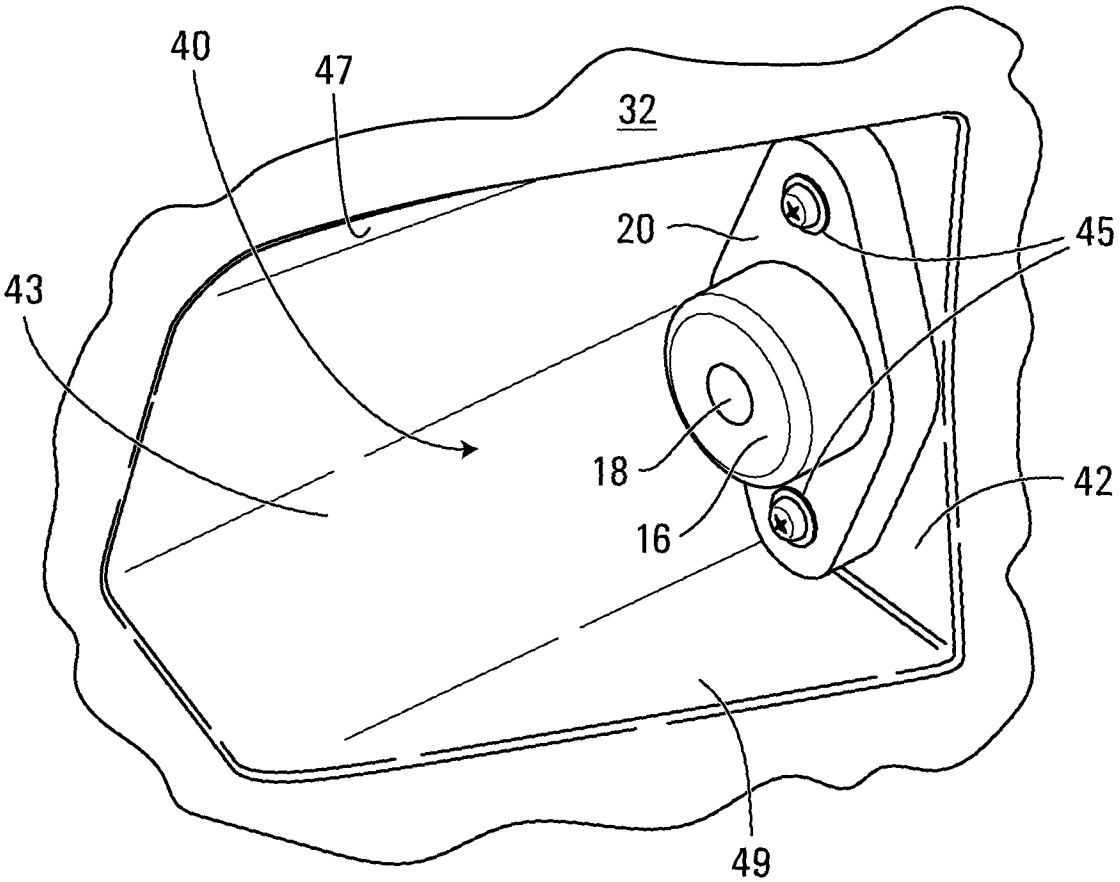
FIG. 4 is outer perspective view of the nozzle of FIG. 1 installed in a recess according to an embodiment of the invention.

As detailed in FIG. 4, a nozzle 10 is mounted in each of the recesses 40 with the flange 20 inset from the component wall 32 and mounted against the rearward wall 42 of the respective recess 40. The cylindrical body 12 extends out through the large hole 44 (see FIG. 3). Each nozzle is mounted by a fastener 45 through each of the two holes 22 of the nozzle 10 aligned with the two small holes 46 of each recess 40. The recesses 40 have the rearward wall 42 which is angled, in this embodiment, at an approximately 75 degree angle to the component wall 32. The recesses 40 also defined by a top wall 47 and a bottom wall 49 which are substantially perpendicular to the component wall 32. An side or inner wall 43 angles from the inner most end of the rear wall 42 out to meet with the surface of the component wall 32 such that the nozzle 10 does not protrude out beyond the surface 33 of the wall 32 but water exiting the nozzle 10 is direct out of the recess 40 at an angle of 10 to 15 degrees from the surface 33 of the wall and across the channel 35 of the component 30. As a result, the cross section of each recess decreases or tapers from the rear wall 42 a surface 33 of the walls 32 of the channel 35. In this embodiment, the cross section of the recess tapers inward without a decrease in height.

In this embodiment, the walls 42, 47 and 49 are substantially planer, with the rearward wall 42 being substantially rectangular and the top and bottom walls 47 and 49 being substantially triangular. The inner wall 43 is formed of two substantially planer sections creating an inwardly angled v-shaped cross-section.

Referring to FIG. 3, in this embodiment, each nozzle 10 is connected at its outlet end 14 (see FIG. 1) to a hose 68 by a clamp 66, such as a gear clamp. The hose 68 may be a flexible PVC (polyvinyl chloride) hose or may be another flexible or inflexible conduit. The other end of each hose 68 is connected to a water supply 70 or other source of water by another gear clamp 66. Each water supply 70 incorporates a supply pipe 72 connected to a distribution pipe 74 which is in turn connected to 10 connector pipes 76 on each side of the section 30. In operation, water is pumped through the supply pipe 72, to the distribution pipe 74, to the connector pipes 76, through the hose 68, through tubular channel 18 of the nozzles 10 and is sprayed out into the channel 35 of the waterslide to impact a vehicle sliding in the channel 35. It will be appreciated that since the three components 30 have different water supplies 70, the flow of water to the three components 30 can be separately controlled, such that, for example, water can be sprayed through the groups of twenty nozzles 10 in each component 30 only when a vehicle approaches and/or is travelling through the component 30.

In some embodiments, there may be a single water supply 70 rather than separate water supplies for different sections 30. In other embodiments, there may be multiple water supplies for each section 30.

Figure 5:
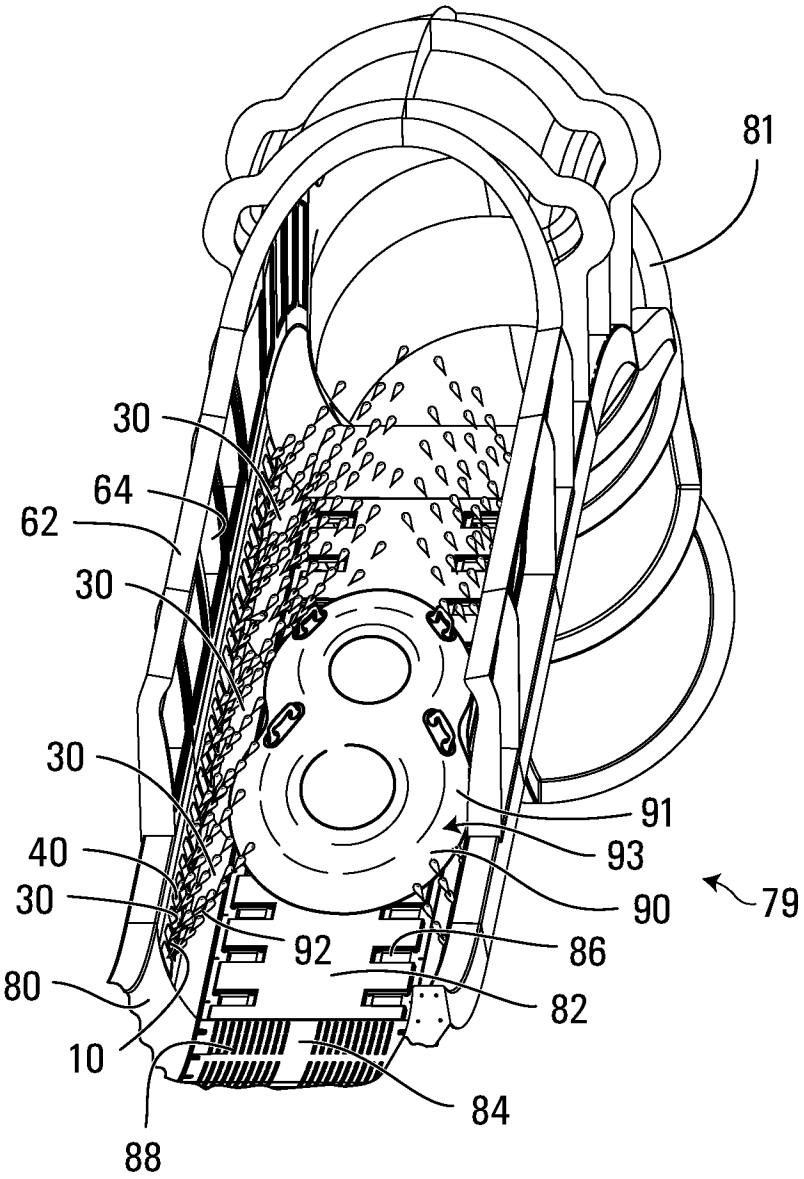
FIG. 5 is an inner perspective view of a section of a waterslide in operation with a vehicle according to an embodiment of the invention.

FIG. 5 provides an interior view of a portion or section of a waterslide 79 in operation. The waterslide 79 incorporates the waterslide feature 60 with the three upwardly angled components 30, a lower section 80 and an exit section 81. In this embodiment, the angled components 30 have a separate sliding surface 82 installed above the bottom 34 of the sections 30 (see FIG. 2). A space is defined between the separate sliding surface 82 and the bottom 34 through which water draining from the separate sliding surface 82 may flow. The separate sliding surface 82 of this embodiment incorporates grates 86 with laterally extending cylindrical slats which extend perpendicular to the flow of water to facilitate drainage of water from the separate sliding surface 82 by a Coanda effect to the space below the separate sliding surface 82.

The lower section 80 defines a local lower section of the waterslide 79. In this embodiment, the lower section 80 has a lower sliding surface 84 with grill openings 88 defined there through. The grill openings extend in the direction of flow of water and allow water to drain from the lower sliding surface 84 to flow in the space between the sliding surface and the bottom of the lower section 80. The water may then be recycled to be reused on the waterslide 79.

In this embodiment, a conventional inflatable figure eight raft or vehicle 90 is depicted as sliding along the sliding surface 82. The vehicle 90 is a typical mass produced raft having sides with a circular cross-section resulting in outwardly curving sides. Riders are not shown but would travel in the vehicle 90. As the vehicle slides from the lower sliding surface 84 onto the upwardly angled sliding surface 82, a flow of water or water jets 92 are sprayed from the nozzles 10 of this section to impact the vehicle 90. The water jets 92 impacting the vehicle 90 and affect the motion of the vehicle 90 by applying a force to propel the vehicle 90 along the upward incline of the sliding surface 82. Before or when the vehicle 90 enters the next section 30, the water jets 92 in that section may be turned on while the water jets 92 in the previous section 30 may be turned off as the vehicle 90 moves beyond those water jets 92.

In some embodiments, the height of the water jets 92 above the sliding surface 82 is no higher than the cross-sectional equator 91 of the rounded sides 93 of the vehicle 90 such that water impacting the vehicle 90 will be substantially deflected downward away from riders (not shown) in the vehicle 90. In some embodiments, the height of the inflatable tubes or sides 93 of the vehicle is 14 inches and the diameter of the tubular channel 18 of the nozzles 10 is 0.5 inches. The diameter of the water jets 92 increase as they spray outward such that the diameter of the spray at the vehicle is approximately 2 to 3 inches. In this embodiment, the nozzles 10 would need to be located and direct water no higher than 6.25 inches from the sliding surface.

In some embodiments, the nozzle flow rate can be varied between 15 and 40 GPM (Gallons Per Minute) and the nozzle pressure can be varied between 5 and 30 psi. In some embodiments, the spray pattern of the water may vary from cylindrical and lower pressure, to conical, at higher pressure.

The embodiment of FIG. 5 depicts a conventional Figure eight inflatable waterslide vehicle 90. In some embodiments, the waterslide vehicle 90 may be modified to provide enhanced momentum when impacted by water jets 92.

Figure 6:
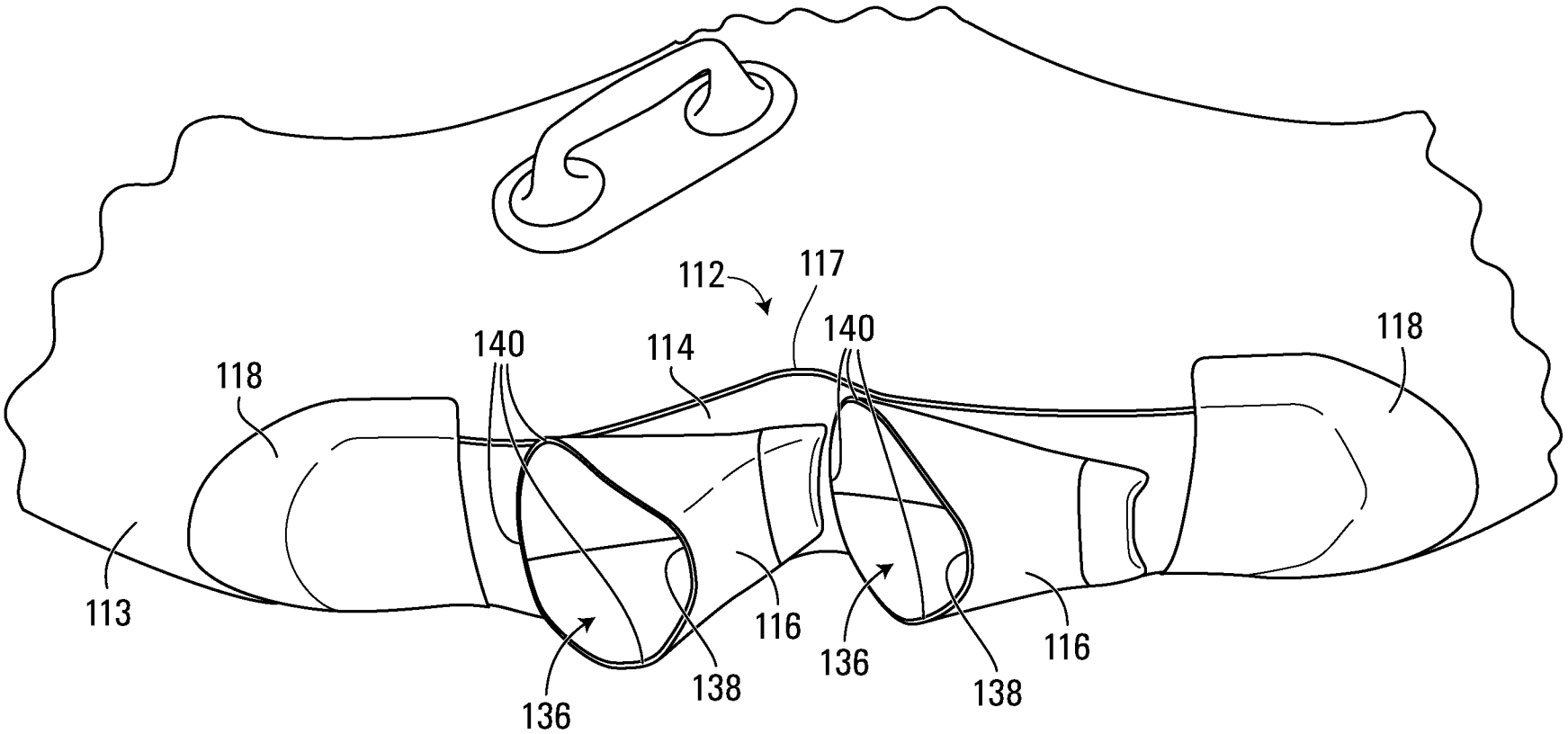
FIG. 6 is a perspective side view of portion of a waterslide vehicle with an attachment according to an embodiment of the invention.
Figure 7:
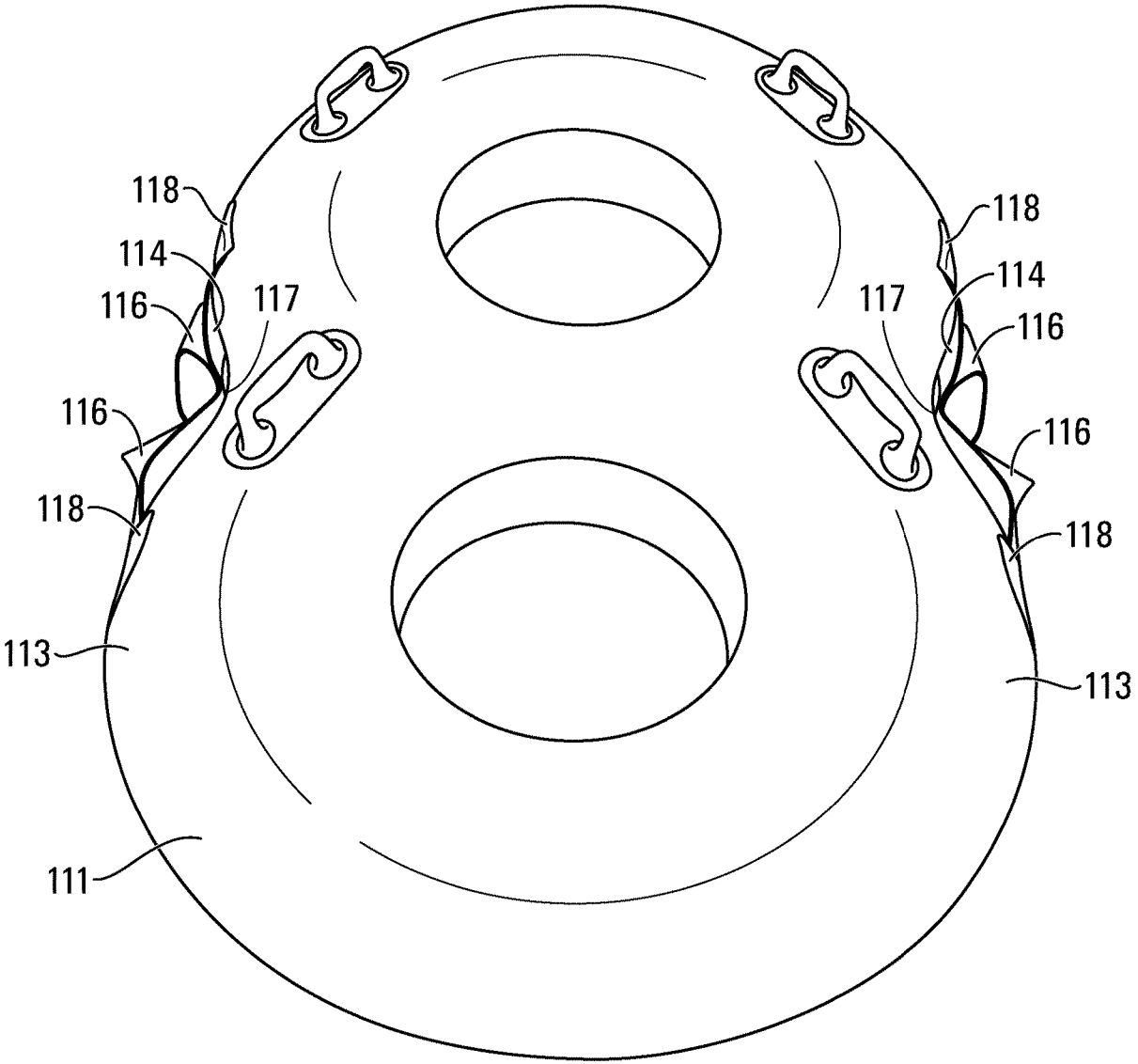
FIG. 7 is a perspective end view of a waterslide vehicle with the attachment of FIG. 6.

FIGS. 6 and 7 show an embodiment of a waterslide vehicle 110 with an attachment 112 mounted to lateral sides 113 of the vehicle 110. In this embodiment, the attachment includes a support structure 114 and two projections 116. The two projections 116 are fastened to the support structure 114 by, for example, an adhesive. The support structure 114 is in turn fastened to the vehicle 110 by adhesive strips 118 at opposite ends and by an adhesive at an intermediate location or area 117.

Figure 8:
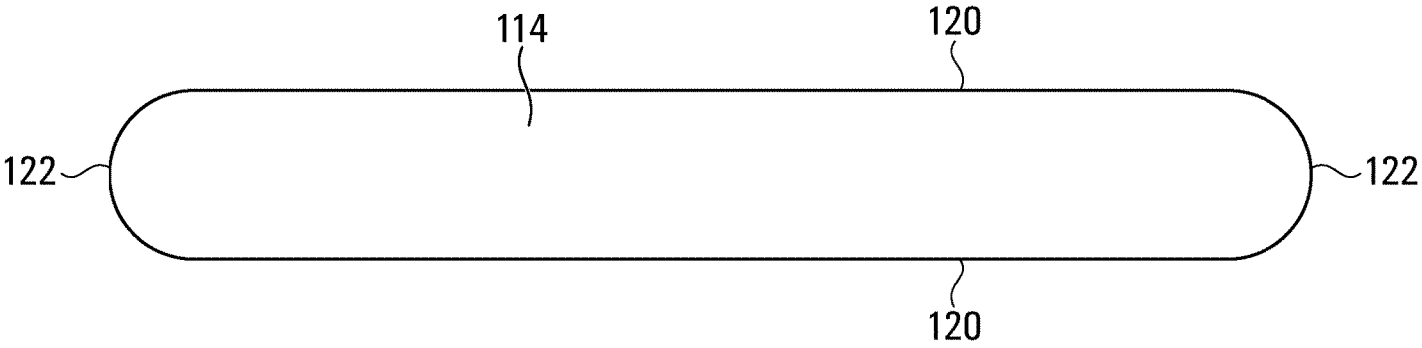
FIG. 8 is a perspective view of a support structure for the attachment of FIG. 6.

The support structure 114 is depicted in FIG. 8. The support structure 114 of this embodiment has an elongated flat shape with parallel longitudinal sides 120 and rounded ends 122. The rounded ends 122 in this embodiment are semicircular and may aid in the retention of the support structure 114 on the vehicle 110 but other shapes may be used. Similarly, the elongated flat shape of the support structure 114 may be replaced with other shapes or multiple elements, such as two square support structures, or completely eliminated and the projections 116 affixed directly to the sides 113 of the vehicle 110.

In this embodiment, the support structure 114 is cut from a relatively thin flexible material, such as supported PVC (4000 Denier PVC, for example). The use of a flexible material which bends may enable the support structure 114 to be more easily affixed to different shapes of vehicles having different side profiles since the support structure may be bent to fit against the sides. In the embodiment of FIGS. 6 and 7, the support structure 114 is bent inward at an intermediate location 117 to be affixed to the recessed area or "waist" of the sides 113 of the figure eight shape of the vehicle 110. It will be appreciated that the flexibility of the support structure 114 could equally allow it be bent to follow and be affixed to the convex side of a round vehicle.

Figure 9:
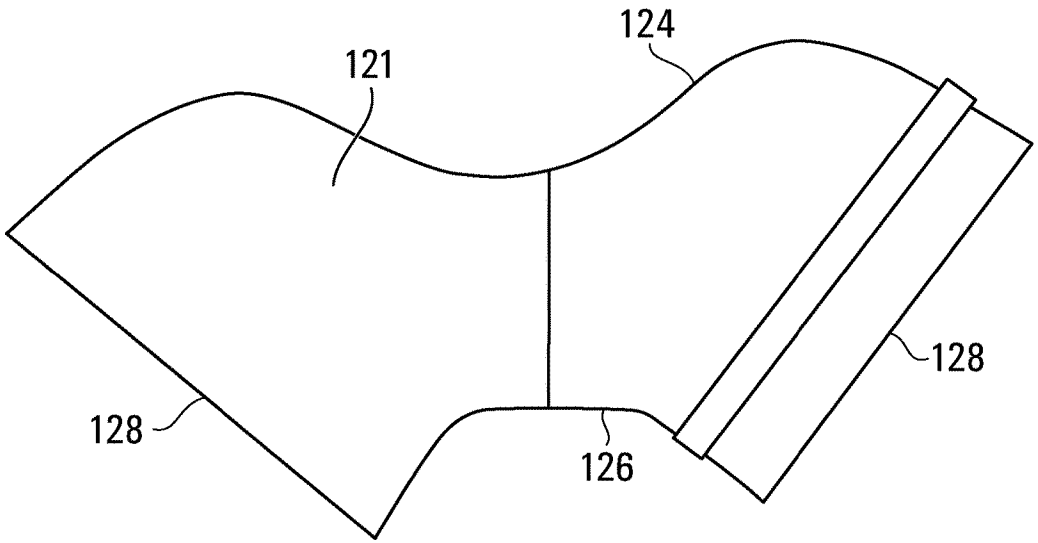
FIG. 9 is a plan view of an unassembled body of a projection for the attachment of FIG. 6.

FIG. 9 depicts the "wing shaped" pattern 121 used to form the body 130 (FIG. 10) of the protrusion 116 of this embodiment. The pattern 121 is symmetrical about a centerline with a "wave shaped" top edge 124 with rounded convex edge portions and a concave center portion. A bottom edge 126 formed of three straight segments, the center segment being parallel to the center portion of the top and the side segments angling downward. The side edges 128 angle outwardly from the bottom edge 126 to the top edge 124. It will be appreciated that numerous different shapes of patterns may be used to form numerous shapes of protrusions.

Figure 10:
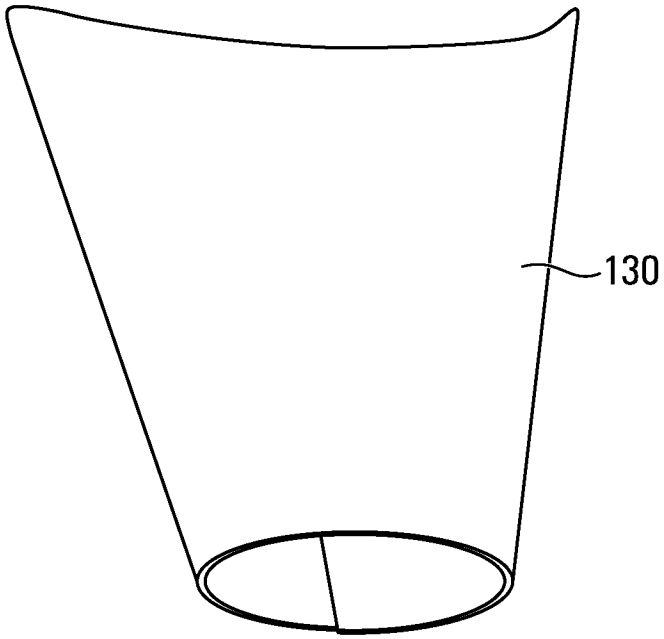
FIG. 10 is a perspective view of the assembled body of FIG. 9.

The pattern 121 of FIG. 9 is also cut from a thin flexible material such that it may be folded or rolled to form the body 130 of the protrusion 116 as shown in FIG. 10. The side edges 128 are overlapped and fastened to each other, for example, by an adhesive (such as a 2-part PVC glue), adhesive strip or other fastener. This results in a body 130 having a flattened cone shape which tapers inward laterally and in decreases depth from the open mouth to the closed end.

Figure 11:
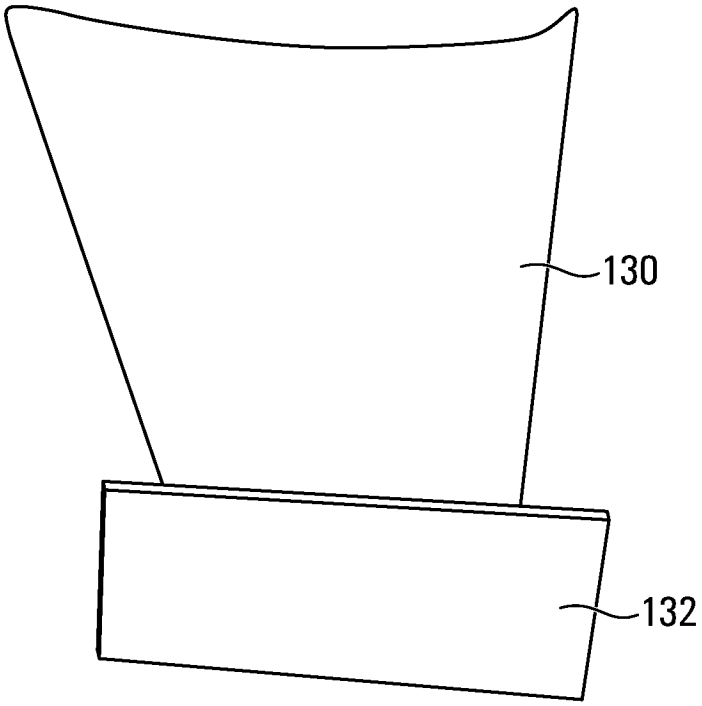
FIG. 11 is a perspective view of the body of FIG. 9 and an unassembled end cap.
Figure 12:
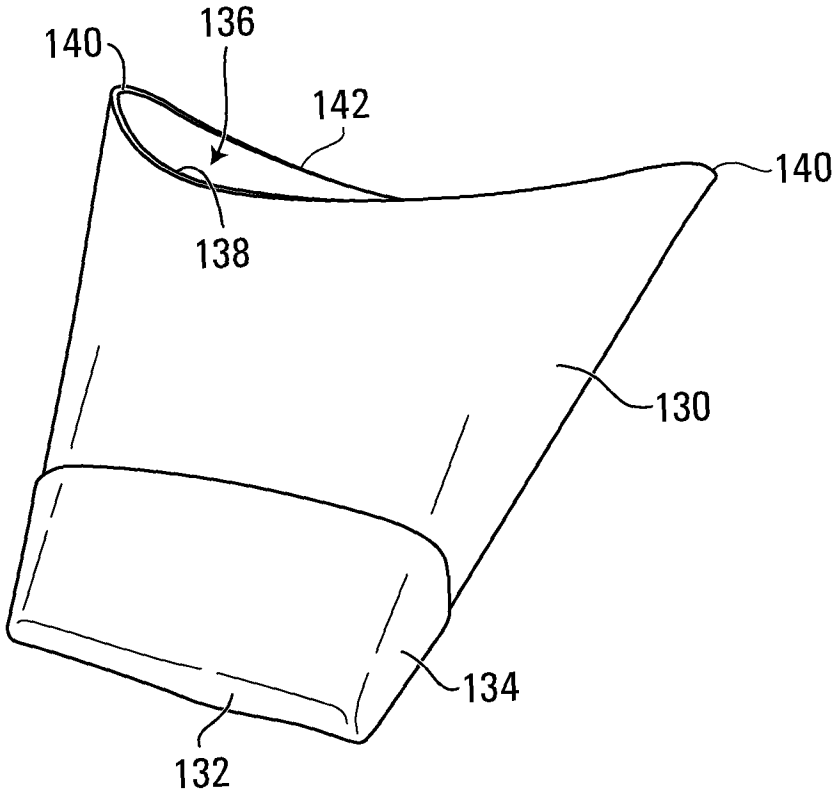
FIG. 12 is a perspective view of an assembled projection for the attachment of FIG. 6.

As shown in FIGS. 10 and 11, the narrow open end of the cone shaped body 130 is then closed, for example, by cutting an end cap 132 of flexible material and fastening it to the narrow end of the body 130. The assembled protrusion 116 of this embodiment, as best seen in FIGS. 6 and 12, has open mouth 136 with a lower front 138 which curves upward and outward to higher sides 140 and back or inner wall 142.

Although the protrusion 116 of this embodiment have been shown as formed by cutting, bending and fastening a flexible material into a desired shape, it will be appreciated that there are numerous other ways of producing such a protrusion 116, such as injection molding a protrusion to form either a flexible or rigid part from plastic or rubber, or by bending and welding a weldable material such as metal.

Figure 13:
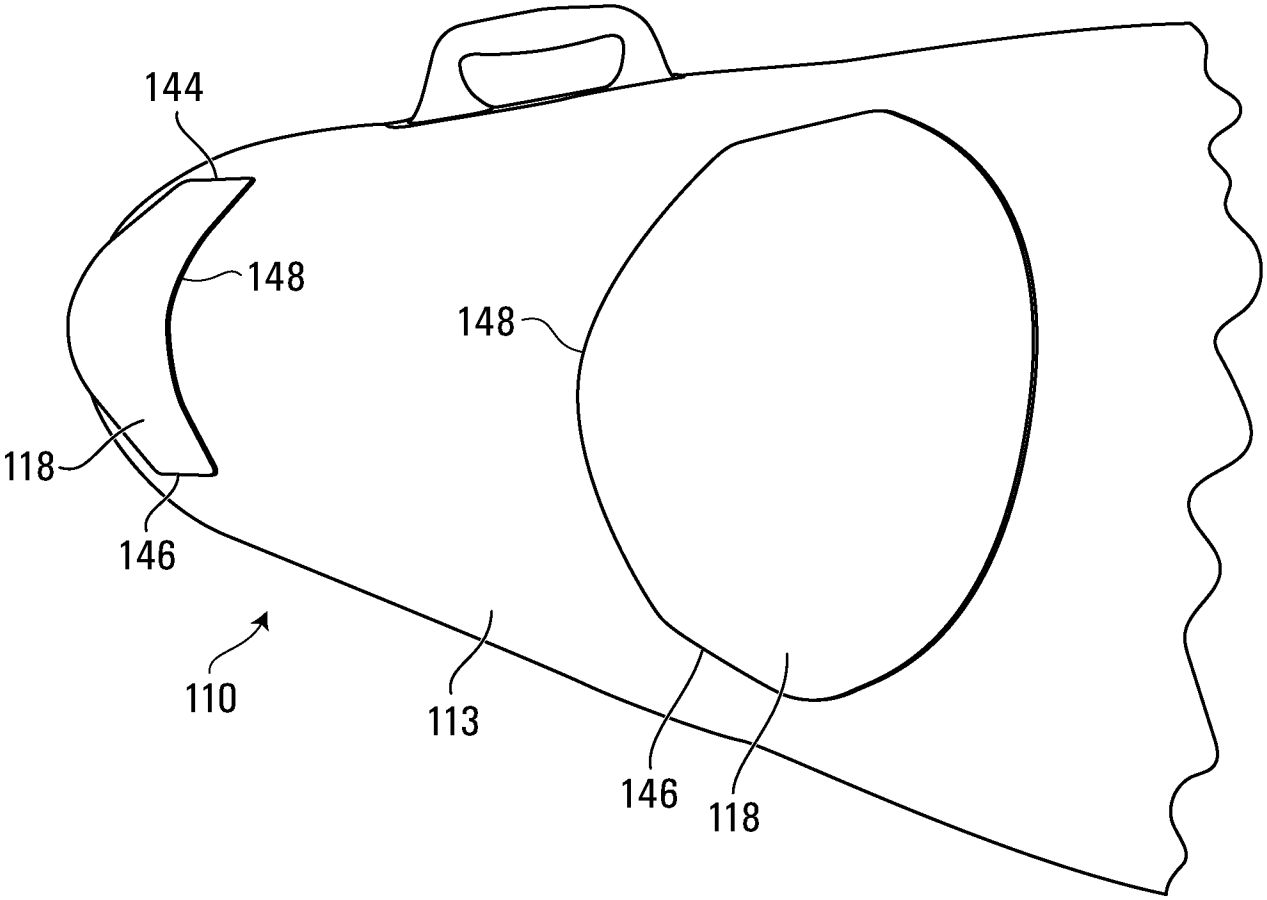
FIG. 13 is an angled side view of the waterslide vehicle of FIG. 7 with adhesive strips attached.

FIG. 13 depicts a side perspective view of the vehicle 110 with the adhesive strips 118 tacked to side 113 of the vehicle 110. In this embodiment, the adhesive strips 118 are complimentary in shape to the ends 122 of the support structure 114. In particular, the adhesive strips 118 have rounded outer ends but are wider than the ends of the support structure 114.

One of the adhesive strips 118 is situated towards the front of the vehicle 110 and the other is situated toward the rear of the vehicle 110 at the widest portions of the vehicle 110 and equidistant from the front and rear of the vehicle 110. The adhesive strips are tacked to the side 113 at the top edges 144 and the bottom edges 146 of the adhesive strips such that there is an opening 148 between the adhesive strips 118 and the side 113. The elongated support structure is thus fixable by its longitudinal ends to each side of the vehicle.

In operation, the protrusions are formed, for example, as described with reference to FIGS. 10 to 12. The protrusions are then affixed to the support structure 114. In this embodiment, two protrusions are used and they are placed end to end along the support structure. In other embodiments, a single or a plurality of protrusions may be used. The mouths 136 of the protrusions 116 of this embodiment are vertically aligned and both facing rearward along the longitudinal length of the vehicle 110. In other embodiments the mouths 136 may be angled upwardly or downwardly and may face in different directions. For example, for a round vehicle the protrusions may be oppositely facing such that the vehicle may be spun in either direction, depending on the direction of a water jet impacting against the protrusions, as discussed further below.

In some embodiments a spoiler, such as a secondary flap or tube, or an enlargement of the tubing in that area, can be fastened to the rear of the vehicle 110 by various means (e.g. adhesive, Velcro, straps) to deflect water downward to contain it within the ride.

Once the protrusions 116 are fastened to the support structure 114, the ends 122 of the support structure 114 may be slid into the openings 148 between the adhesive strips 118 and the side 113 of the vehicle 110. The adhesive strips 118 can then be fastened to the side 113 and the support structure 114 such that the support structure 114 is fastened to the vehicle 110. In some embodiments, an adhesive may also be used to fasten a back surface of the support structure 114 to the side 113, for example, at a midpoint of the support structure 114 to the waist or narrow portion of the vehicle 110, or at other locations or all along the length of the support structure 114.

In the present embodiment, the assembly of the support structure 114 and protrusion 116 is symmetrical along it longitudinal axis such that the same form of assembly can be positioned along both sides of the vehicle 110.

Although adhesive strips 118 are show, these strips may be eliminated or combined with other adhesives for fastening the support structure 114 and protrusions 116 to the vehicle 110. In some embodiments, the support structure 114 may be eliminated and the protrusions fastened directly to the side 113 of the vehicle 110.

Figure 14:
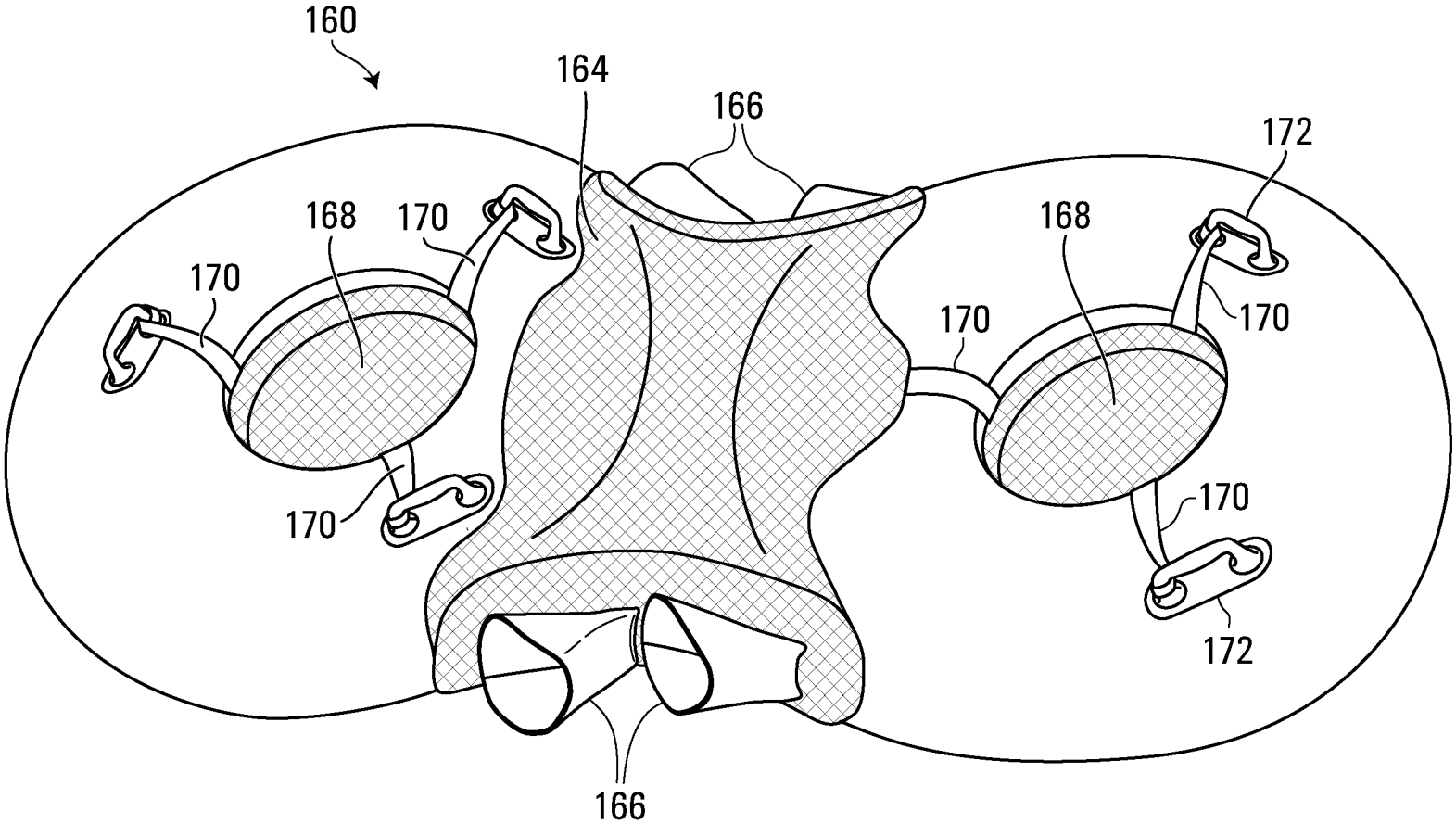
FIG. 14 is a perspective side view of a waterslide vehicle with an attachment according to another embodiment of the invention.

FIG. 14 depicts another embodiment in which a vehicle 60 has a sleeve 164 which provides both support for protrusions 166 and for seats 168. In particular, the sleeve 164 is formed of a flexible tubular material which is slipped over the vehicle 160 when the vehicle 160 is not inflated or is under inflated. The protrusions 166 may be formed as the protrusions 116, described above, or may be integrally formed with the sleeve 164 by weaving or molding. Straps 170 may interconnect both handles 172 of the vehicle and the sleeve 164 to the seats 168 to support and retain the seats 168 in position. It will be appreciated that either the protrusions 166 or the seats 168 may be eliminated from this structure or may be otherwise supported, for example, by an adhesive, or by the contours of the vehicle when inflated.

It will be appreciated that the assembly of the protrusions and support structure may be provided as a kit for adapting conventional mass produced water ride vehicles, such as vehicle 110, to be used with water rides which employ water spray or jets to affect the motion of a waterslide vehicle.

Figure 15:
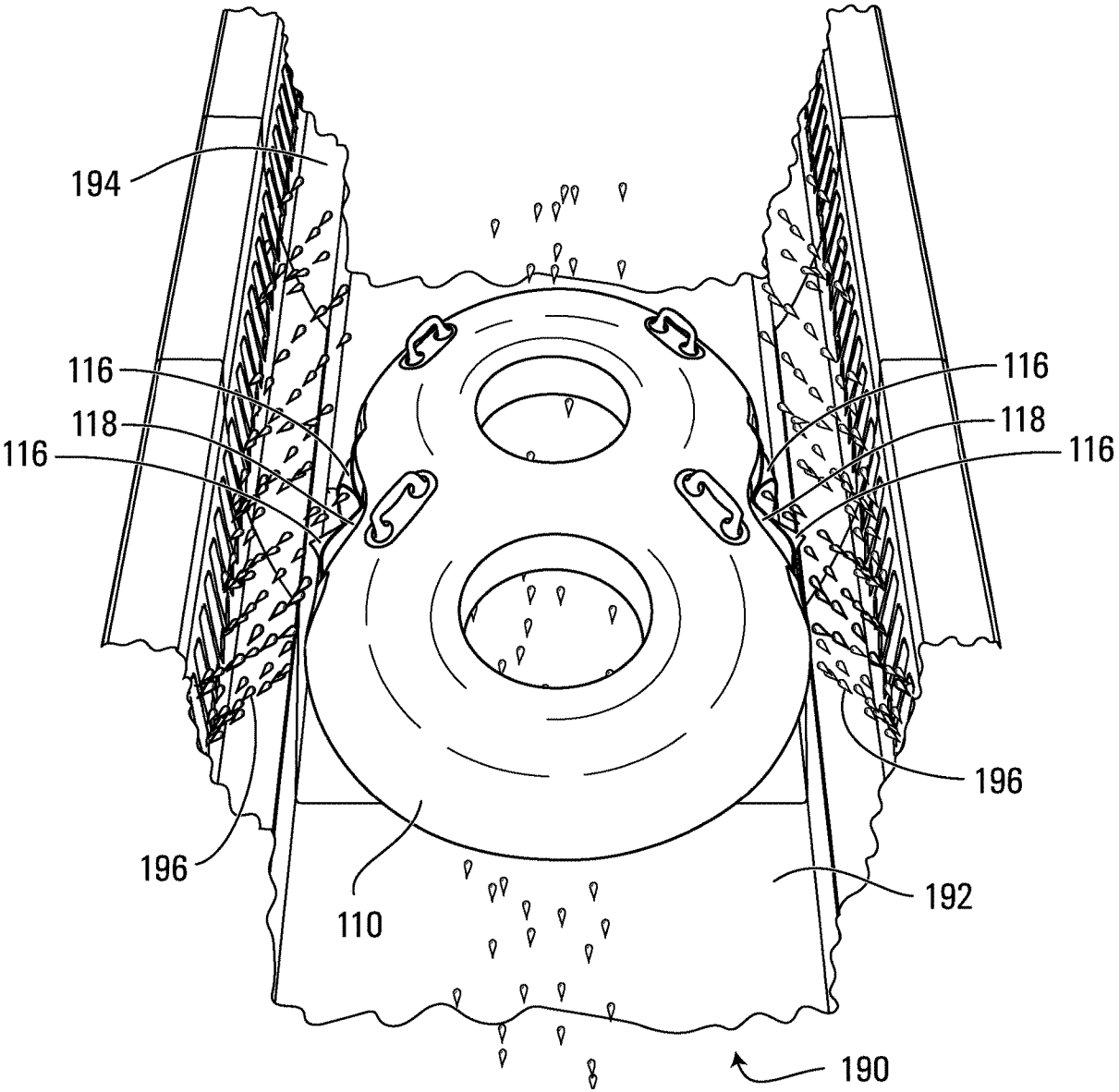
FIG. 15 is a plan view of the waterslide vehicle of FIG. 7 in a water slide.

In particular, with reference to FIG. 15, the vehicle 110 may be positioned in a channel 190 of a flume style waterslide having a central sliding surface 192 between two walls 194. Spaced along the sides of the sliding surface 192 are spray or water jet sources (see FIGS. 1-5). The water jets 196 impact spray into the mouths 136 of the protrusions 116 as the vehicle 110 slides along the sliding surface 192 past the water jets 196 to impose a force to push the vehicle 110 along the sliding surface 192.

In some embodiments, the assembly of support structure 114 and protrusion assemblies may be removed from the vehicle 110 at the end of the vehicle life, by cutting or removing or otherwise dissolving the adhesive. The assembly may then be reused on another vehicle.

The vehicle may be used with the waterslides of PCT application numbers PCT/CA2013/050794 and PCT/CA2015/050339 both of which are incorporated herein in their entirety.

Numerous modifications and variations of the present invention are possible in light of the above teachings. It is therefore to be understood that within the scope of the appended claims, the invention may be practised otherwise than as specifically described herein.

The invention claimed is:

1. A waterslide feature comprising:

a channel comprising a sliding surface and walls;

the walls defining a plurality of recesses;

a plurality of nozzles comprising a nozzle extending through each of the recesses angled to spray water above the sliding surface;

wherein the nozzles are positioned to provide a flow of water to impact the sides and rear of a vehicle sliding on the sliding surface;

wherein the nozzles are sized to provide a flow of water sufficient to affect motion of the vehicle; and wherein the nozzles are configured to be mounted in the recesses and removable from within the channel.

2. The waterslide feature according to claim 1 wherein each of the recesses defines an opening though the walls and each of the nozzles are connected to a source of water through the respective openings in the walls.

3. The waterslide feature according to claim 2 wherein each of the recesses define a rear wall angled towards the channel for mounting one of the nozzles and the cross section of each recess tapers from the rear wall to a surface of the channel.

4. The waterslide feature according to claim 3 wherein the recesses taper inward to define top and bottom walls substantially perpendicular to the rear wall and the channel.

5. The waterslide feature according to claim 1 wherein each of the nozzles define an outlet end which is within the respective recess and an inlet end which is outside the channel.

6. The waterslide feature according to claim 1 wherein the nozzles are formed of polyvinyl chloride.

7. The waterslide feature according to claim 1 wherein each of the nozzles comprise a collar within the respective recess and a cylinder extending outside the channel.

8. The waterslide feature according to claim 5 wherein the inlet end comprises a press fit feature which is fitted into a flexible conduit connected by a clamp.

9. The waterslide feature according to claim 8 wherein the plurality of nozzles are connected to a water source in groups wherein the flow of water to each group is separately controlled.

10. The waterslide feature according to claim 1 wherein a water flow rate is variable between 15 GPM and 40 GPM per nozzle.

11. The waterslide feature according to claim 1 wherein water pressure in the nozzle is variable between 5 psi and 30 psi.

12. The waterslide feature according to claim 1 wherein the nozzle spray pattern is variable from cylindrical to conical.

13. The waterslide feature according to claim 1 wherein the nozzles are positioned spray no more than 6.25 inches above the sliding surface.

14. The waterslide feature according to claim 1 wherein the nozzles are positioned spray less than approximately 8.75 inches above the sliding surface.

15. The waterslide feature according to claim 1 further comprising troughs along the sides of the uphill and downhill sections of the sliding surface.

16. The waterslide feature according to claim 1 further comprising a trough below the sliding surface and grates along uphill and downhill sections of the sliding surface opening into the trough to allow water to flow from the sliding surface to the trough, wherein the grates comprise laterally extending cylindrical bars.

17. The waterslide feature according to claim 1 wherein the waterslide comprises upper walls including removable windows.

18. The waterslide feature according to claim 17 wherein the upper walls enclose the waterslide feature.

19. The waterslide system comprising a waterslide feature according to claim 1 and an inflatable waterslide vehicle with outwardly curving sides wherein the water jets are angled to impact the vehicle no higher than a cross-sectional equator of the sides of the vehicle.

20. The waterslide system according to claim 19 wherein the water jets are angled to impact the vehicle below the cross-sectional equator of the sides of the vehicle.

* * * * *